US010081903B2

(12) United States Patent
Chua et al.

(10) Patent No.: US 10,081,903 B2
(45) Date of Patent: Sep. 25, 2018

(54) STEAM IRON

(71) Applicant: KONINKLIJKE PHILIPS N.V., Eindhoven (NL)

(72) Inventors: Hee Keng Chua, Eindhoven (NL); Boon Teck Tan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 19 days.

(21) Appl. No.: 15/504,031

(22) PCT Filed: Aug. 11, 2015

(86) PCT No.: PCT/EP2015/068403

§ 371 (c)(1),
(2) Date: Feb. 15, 2017

(87) PCT Pub. No.: WO2016/030176

PCT Pub. Date: Mar. 3, 2016

(65) Prior Publication Data

US 2017/0268160 A1 Sep. 21, 2017

(30) Foreign Application Priority Data

Aug. 26, 2014 (EP) ..... 14182184

(51) Int. Cl.
*D06F 75/12* (2006.01)
*D06F 75/10* (2006.01)

(52) U.S. Cl.
CPC ..... *D06F 75/12* (2013.01); *D06F 75/10* (2013.01)

(58) Field of Classification Search
CPC ..... D06F 75/02; D06F 75/06; D06F 75/08; D06F 75/10; D06F 75/12; D06F 75/20;
(Continued)

(56) References Cited

U.S. PATENT DOCUMENTS 1,593,897 A * 7/1926 Brewer ..... D06F 75/12 38/77.6
1,674,092 A * 6/1928 Brewer ..... D06F 75/12 38/77.6

(Continued)

FOREIGN PATENT DOCUMENTS

DE 102004032361 A1 8/2005
EP 2418318 A1 2/2012

(Continued)

*Primary Examiner* — Ismael Izaguirre

(57) ABSTRACT

A steam iron (10) comprising a soleplate (13), a heating element (14) for heating the soleplate (13), an inlet junction (16) comprising a first inlet (28) for receiving input steam from a steam generator and a second inlet (29), a water-steam separator (18) connected to the inlet junction (16) to receive steam from the inlet junction (16) and separate steam from condensed water entrained in the steam. The steam iron also includes an evaporation chamber (19) connected to the water-steam separator (18) to receive condensed water from the water-steam separator (18) and which includes a surface heated by the heating element (14) to generate evaporated water from the condensed water. The evaporation chamber (19) is connected to the second inlet (29). The inlet junction (16) comprises a venturi effect nozzle (31) for expelling the input steam and to generate a reduced pressure in the region of the second inlet (29) to draw the evaporated water into the inlet junction (16). The venturi nozzle (31) is disposed within an outer tube (32) of the inlet junction (16) and the second inlet (29) is positioned upstream of the end of the venturi nozzle (31) from which the input steam is expelled, with respect to the flow direction of the steam.

14 Claims, 3 Drawing Sheets

(58) Field of Classification Search
CPC ..... D06F 75/24; B01D 1/00; B01D 1/0011; B01D 1/0064; B01D 1/02; B01D 1/06; B01D 1/14; B01F 3/02; B01F 3/04; F28B 1/00; F28B 1/06
See application file for complete search history.

(56) References Cited

U.S. PATENT DOCUMENTS

| | | | | | |
|---|---|---|---|---|---|
| 2,460,546 | A * | 2/1949 | Stephanoff | B01D 1/18 | 159/4.01 |
| 2,803,073 | A * | 8/1957 | Raihle | D06F 75/16 | 38/77.82 |
| 2,815,593 | A * | 12/1957 | Reimers | D06F 75/12 | 38/77.6 |
| 8,615,909 | B2 * | 12/2013 | Pang | D06F 75/20 | 38/77.6 |
| 2003/0000116 | A1 * | 1/2003 | Yao | D06F 75/06 | 38/77.6 |
| 2004/0026802 | A1 * | 2/2004 | Birdsell | F24F 6/10 | 261/128 |
| 2014/0150736 | A1 * | 6/2014 | Hirata | F22D 11/06 | 122/441 |

FOREIGN PATENT DOCUMENTS

| | | | |
|---|---|---|---|
| EP | 2808439 | A1 | 12/2014 |
| TK | 2008065619 | A1 | 6/2008 |
| WO | 9925915 | A1 | 5/1999 |
| WO | WO 2016030406 | A1 * | 3/2016 |

* cited by examiner

STEAM IRON

This application is the U.S. National Phase application under 35 U.S.C. § 371 of International Application No. PCT/EP2015/068403, filed on Aug. 11, 2015, which claims the benefit of International Application No. 14182184.3 filed on Aug. 26, 2014. These applications are hereby incorporated by reference herein.

FIELD OF THE INVENTION

The present invention relates to a steam iron and, in particular, to a steam iron with improved steam processing means to enable lighter weight construction than conventional steam irons.

BACKGROUND OF THE INVENTION

A Pressurised Steam Generator ("PSG") iron is a steam iron with high steam output. Steam is usually generated in a separate steam generator located in a stand away from the iron. A hose connecting the steam generator and the iron delivers the steam to the iron upon activation of an electrovalve actuated by a user-operated button on the iron. However, the relatively cold hose connecting the steam generator and the iron, especially during initial start-up for the apparatus, causes the steam to condense onto the inner wall of the hose during delivery. This results in an undesirable amount of liquid water being delivered to the iron together with the steam, which may cause spitting of water from the iron.

Known PSG irons may include a high heat capacity soleplate with one or more embedded heating elements which stores enough energy to re-evaporate any condensed water supplied via the hose from the steam generator. In addition to this required thermal mass of the soleplate, the power of the heating element(s) should be sufficient to reheat the soleplate back to a pre-determined set temperature, and such heating elements may have a power of around 800 W. Consequently, the soleplate mass is high and is a major factor in the overall weight of the iron. The resulting heavy iron makes prolonged use tiring and also makes vertical ironing/steaming difficult.

An alternative known method of preventing spitting due to condensed water formed in a steam iron hose is to employ a water-steam separator. Such an apparatus is described in WO/1999/025915A1. However this type of solution requires an additional means to handle the separated water and so does not facilitate provision of a lighter weight iron, since the additional parts of the water separation means lead to added weight. Furthermore, some known irons include a water return system to delivery condensed water back to the reservoir in the stand. However, the cord connecting the iron to the stand therefore needs two hoses (for steam delivery to the iron, and water return to the stand), which means the hose cord is stiff and heavy, restricting movement of the iron during ironing and reducing overall manoeuvrability of the iron.

Within the terms of Art. 54(3) European Patent Convention, it is known from EP2808439 (filed on May 6, 2014, published on Dec. 3, 2014) to provide a steam iron comprising a soleplate, a heating element for heating the soleplate, an inlet junction comprising a first inlet for receiving input steam from a steam generator and a second inlet, a water-steam separator connected to the inlet junction to receive steam from the inlet junction and separate steam from condensed water entrained in the steam, an evaporation chamber connected to the water-steam separator to receive condensed water from the water-steam separator and including a surface heated by said heating element to generate evaporated water from said condensed water, the evaporation chamber being connected to the second inlet, wherein the inlet junction comprises a venturi effect nozzle for expelling said input steam and to generate a reduced pressure in the region of the second inlet to draw said evaporated water into the inlet junction.

SUMMARY OF THE INVENTION

It is an object of the invention to provide a steam iron with a configuration that enables the steam iron to be of a lighter weight than conventional steam irons.

The invention is defined by the independent claims. The dependent claims define advantageous embodiments.

According to the present invention, there is provided a steam iron comprising a soleplate, a heating element for heating the soleplate, an inlet junction comprising a first inlet for receiving input steam from a steam generator and a second inlet, a water-steam separator connected to the inlet junction to receive steam from the inlet junction and separate steam from condensed water entrained in the steam, an evaporation chamber connected to the water-steam separator to receive condensed water from the water-steam separator and including a surface heated by said heating element to generate evaporated water from said condensed water, the evaporation chamber being connected to the second inlet, wherein the inlet junction comprises a venturi effect nozzle for expelling said input steam and to generate a reduced pressure in the region of the second inlet to draw said evaporated water into the inlet junction, wherein the venturi nozzle is disposed within an outer tube of the inlet junction and the second inlet is positioned upstream of the end of the venturi nozzle from which the input steam is expelled, with respect to the flow direction of the steam.

This advantageously ensures the second inlet is disposed in a region of low pressure within the inlet junction to promote evaporated water from the evaporation chamber to be effectively drawn through the evaporation chamber and into the inlet junction.

An inlet duct may fluidly connect an outlet of the outer tube to an inlet of the water-steam separator, and the cross-sectional area of the inlet duct and of the inlet of the water-steam separator may each be greater than the cross-sectional area of the outlet of outer tube.

This reduces the flow resistance downstream of the outlet of the inlet junction to promote creation of low pressure zones at the inlet junction by the venturi effect nozzle.

The water-steam separator may comprise a steam outlet for dry steam to be supplied to steam vents formed in the soleplate, and a water outlet connected to the evaporation chamber. This ensures separate supply of dry steam to the steam vents and condensed water to the evaporation chamber.

The cross-sectional area of the steam outlet of the separator may be greater than the cross-sectional area of an outlet of outer tube of the inlet junction. This further promotes reduction in the flow resistance downstream of the outlet of the inlet junction to promote creation of low pressure zones at the inlet junction by the venturi effect nozzle.

The total cross-sectional area of the steam vents in the soleplate may be greater than the cross-sectional area of an outlet of outer tube of the inlet junction. This yet further promotes reduction in the flow resistance downstream of the outlet of the inlet junction to promote creation of low pressure zones at the inlet junction by the venturi effect nozzle.

Part of the evaporation chamber may be defined by a surface of the soleplate. The advantageously allows a space-efficient construction of the steam iron by not requiring a separate evaporation chamber wall adjacent to the sole plate, and also enables the heating element to heat both the soleplate and the evaporation chamber.

The second inlet of the inlet junction may comprise a duct that extends into the evaporation chamber and terminates at a distal end which is spaced from an opposite surface of the evaporation chamber by a gap of between 1 mm-4 mm. The gap may advantageously be around 2 mm.

This provides the advantage of helping any unevaporated water that may be present on the upper surface of the soleplate to be sucked up into the inlet junction by the low pressure of the venturi effect. It may then be atomised or otherwise reduced into much finer droplets entrained in the expelled steam from the inlet junction to accelerate evaporation of the water to steam.

The evaporation chamber may comprise a convoluted path between the water-steam separator and the second inlet of the inlet junction, defined by a plurality of upstanding walls from a surface of the evaporation chamber.

This provides a greater surface area for the water droplets to travel across within the evaporation chamber to maximise the evaporation of the water within the evaporation chamber.

The upstanding walls defining the convoluted path may be formed integrally with the soleplate.

This enables an efficient and space-saving construction of the steam iron, and enables an efficient transfer of heat from the heating element to the surfaces of the evaporation chamber upon which the condensed water is to be evaporated.

The water-steam separator may advantageously comprise a cyclonic separator for an efficient separation effect and a compact water-steam separator configuration.

The soleplate may have a mass of around 400 g, which advantageously provides a lighter steam iron for more versatile use by a user, and prolonged use without fatigue by a user. The mass of the steam iron may be within the range of 650 g to 800 g, for the same advantageous effect.

The soleplate heating element may have a power output of less than 500 W which advantageously makes operation of the steam iron more power efficient, enables a more powerful steam generator to be provided and remain within regulatory total power consumption figures for the apparatus.

This provides a more effective steam iron as more steam may be generated for garment treatment.

The steam iron may further comprise a separate base unit comprising a steam generator including a water reservoir and a boiler, and a steam hose connecting the steam generator to the first inlet of the inlet junction, wherein the steam hose comprises a single duct for the supply of steam from the steam generator to the steam iron. The single-duct steam hose makes the steam hose lighter and more flexible than a double-duct steam hose used in devices with a condensed water return hose as well as a steam supply hose. The configuration of the steam iron of the invention negates the need for any condensed water return hose as any condensed water is converted to steam in the steam iron. Therefore, the steam iron of the invention is lighter and more manoeuvrable than known steam irons.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
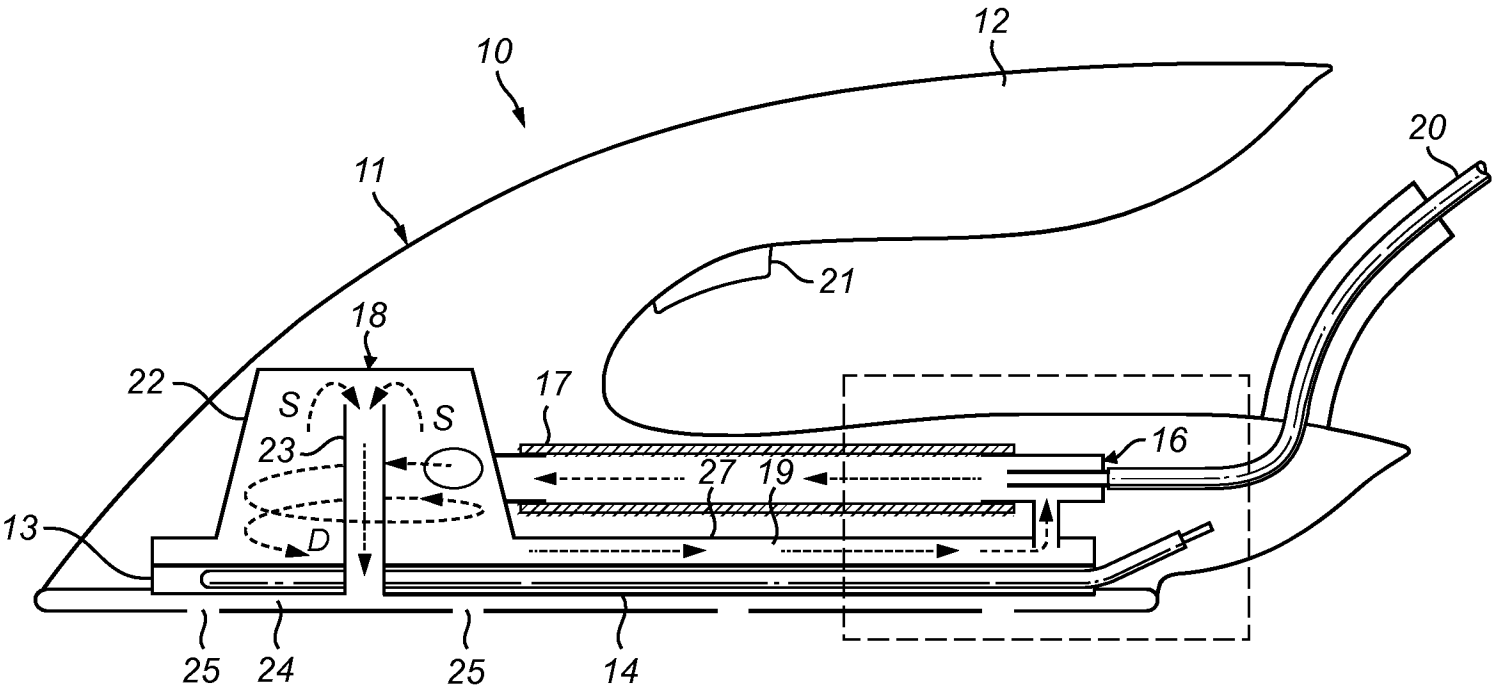
FIG. 1 shows a schematic cross-sectional view of a steam iron of the invention.
Figure 2:
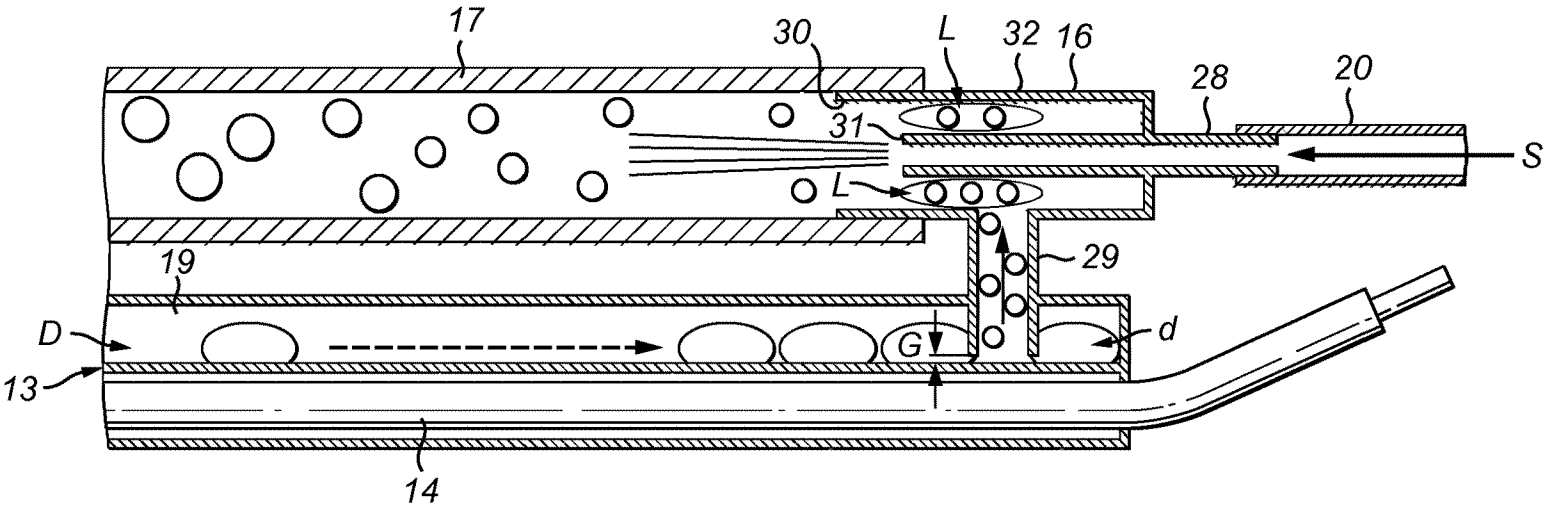
FIG. 2 shows an enlarged schematic cross-sectional view of a portion of the steam iron of FIG. 1.
Figure 3:
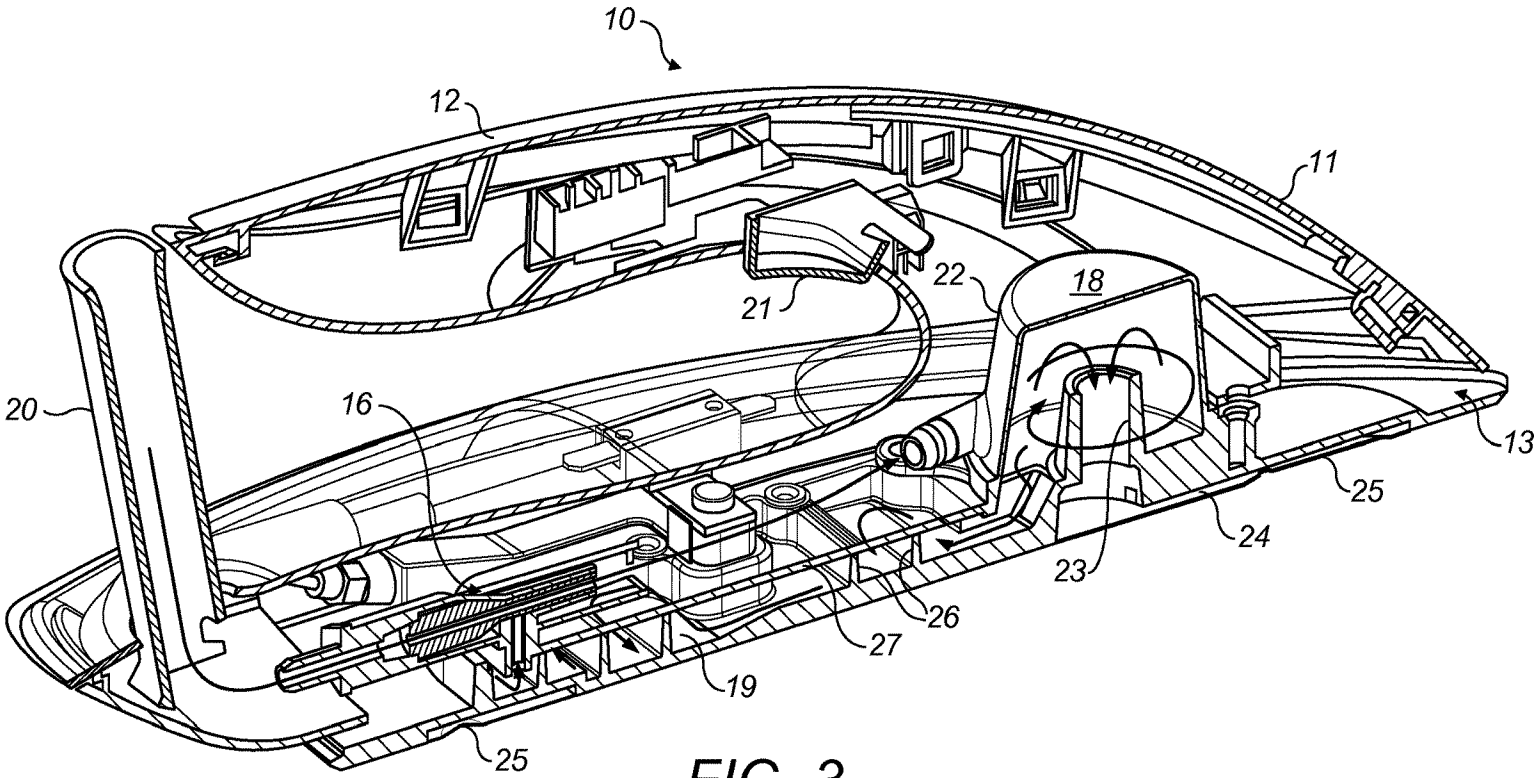
FIG. 3 shows a cross-sectional view of a steam iron of the invention.

Referring now to the figures, FIG. 3 shows a steam iron 10 of the invention, and FIGS. 1 and 2 respectively show simplified schematic views of the steam iron 10 and an enlarged portion of the steam iron 10 of the invention to more clearly illustrate its configuration and operation. The steam iron 10 comprises a body portion 11 including a handle 12 and a soleplate 13 connected to the body 11. The soleplate 13 includes a heating element 14. The heating element 14 may, in an exemplary embodiment of the invention, comprise an electrical heating element. References hereafter to "upper" and "lower", or "top" and "bottom" portions of the steam iron 10 are with respect to the steam iron 10 being in an operative position as shown in FIGS. 1 and 3 with the soleplate 13 oriented in a generally horizontal plane.

The steam iron 10 also comprises an inlet junction 16, a water-steam separator 18, and an evaporation chamber 19 fluidly connected between the water-steam separator 18 and the inlet junction 16. In the exemplary embodiment of the steam iron 10 of the invention shown in FIGS. 1 to 3, the inlet junction 16 is connected to the water-steam separator 18 by an inlet passage 17. However, the invention is not limited to this configuration and the inlet junction 16 may, for example, be fluidly connected directly to the water-steam separator 18 without a separate connecting duct. Steam is supplied to the inlet junction 16 from a steam generator in a separate stand (not shown) via a steam hose 20 which is connected to the inlet junction 16. In an exemplary embodiment of the invention, the water-steam separator may comprise a cyclonic separator.

The handle 12 includes a user-operable button 21 which is electrically connected to the steam generator in the stand (not shown) to activate an electro-valve to release steam to the iron 10 when the button 21 is actuated.

The water-steam separator 18 comprises a frusto-conical housing 22 tapering from a top portion to a bottom portion. A central steam tube 23 is provided within the frusto-conical housing 22 and has an open top end proximate the top of the frusto-conical housing 22 and a bottom end that is in fluid communication with a steam vent distribution chamber 24 in the soleplate 13. The steam vent distribution chamber 24 includes a number of steam vents 25 though which steam provided to the steam vent distribution chamber 24 from the steam tube 23 of the water-steam separator 18 may be expelled onto garments being treated.

The evaporation chamber 19 comprises a duct that connects the wider bottom end of the frusto-conical housing 22 to the inlet junction 16. One side of the evaporation chamber 19 comprises an upper surface of the soleplate 13, which is therefore a heated surface. As can be seen from FIG. 3, the evaporation chamber 19 comprises a convoluted duct defined by the upper surface of the soleplate 13, upstanding walls 26 on the upper surface of the soleplate 13, and a steam cover 27 which seals across the tops of the upstanding walls 26. The upstanding walls 26 are therefore also heated by the heating element 14.

The portion of the steam iron 10 within the dashed rectangle in FIG. 1 is shown as an enlarged schematic view in FIG. 2. The inlet junction 16 includes a first inlet 28 and a second inlet 29, and an outlet 30. The first inlet 28 is connected to the steam hose 20 for supply of steam (shown by arrow "S" in FIG. 2), the second inlet 29 is connected to the end of the evaporation chamber 19 remote from the water-steam separator 18, and the outlet 30 is connected to the inlet passage 17. The inlet junction comprises a venturi-effect nozzle, and as such includes a narrow inner nozzle 31 connected to the first inlet 28, and a wider outer pipe 32. The narrow inner nozzle 31 is disposed within the outer pipe 32 and the outer pipe 32 includes the second inlet 29 and the outlet 30.

In use of the steam iron 10, a user actuates the button 21 which activates an electro-valve (not shown) in a steam generator in a separate stand (not shown) to cause pressurised steam to be supplied through the steam hose 20 to the steam iron 10. The steam enters inlet junction 16 through the first inlet 28 and is expelled into the inlet passage 17 through the end of the narrow inner nozzle 31. The narrow inner nozzle 31 causes the steam to be expelled at high velocity into the inlet passage 17. Any steam that has condensed in the steam hose 20 into liquid water is expelled with the steam as water droplets "d" (see FIG. 3) into the inlet passage 17.

The steam and entrained water droplets are propelled along the inlet passage 17 and tangentially into the water-steam separator 18 where they spin in a vortex within the frusto-conical housing 22. The heavy water droplets fall to the bottom of the water-steam separator 18 and into the evaporation chamber 19, as shown by arrows "D" in FIGS. 1 and 2. The dry steam passes to the top of the water-steam separator 18 and into the central steam tube 23, as shown by arrows "S" in FIG. 1, from where the steam passes into the steam vent distribution chamber 24 and is expelled out of the steam vents 25 onto a garment being treated.

The water droplets d that fall to the bottom of the water-steam separator 18 flow through the evaporation chamber 19 towards the inlet junction 16. The heat of the soleplate 13 and the upstanding walls 26 in the evaporation chamber 19 heat the water droplets d and evaporate them into steam. This steam is drawn into the inlet junction by the venturi-effect caused by the narrow inner nozzle 31 within the outer pipe 32. That is, the accelerated steam expelled from the narrow inner nozzle 31 causes a region of low pressure "L" (illustrated by circles in FIG. 2) within the outer pipe 32 upstream of the outlet end of the inlet pipe 31. The second inlet 29 is disposed upstream of the end of the narrow inner nozzle 31 with respect to the flow direction of the steam flowing out of the narrow inner nozzle 31. The low pressure region L draws the steam from the evaporation chamber 19 through the second inlet 29 and into the outer pipe 32 from where it mixes with the steam being expelled from the narrow inner nozzle 31 and which together are then expelled from the outlet 30 into the inlet passage 17. The drawing of steam from the evaporation chamber 19 in this way also draws the water droplets d into the evaporation chamber 19 from the water-steam separator 18.

Once in the inlet passage 17, the steam passes again to the water-steam separator 18 where remaining water droplets are separated from the steam as described above to be evaporated into steam in the evaporation chamber 19. This looping of the water droplets from the water-steam separator 18, through the evaporation chamber 19 and, as steam, back to the inlet junction 16 continues whilst the steam iron 10 is in use until the water all leaves the water-steam separator 18 as dry steam.

With the above-described configuration of venturi-effect inlet junction 16, condensed water from the steam hose 20 can be retained in the soleplate 13 for a longer period until it gets re-evaporated into steam again. Alternatively, the water can be retained inside the evaporation chamber 19 for slow evaporation while the steam iron 10 is at rest (for example, when a user changes or adjusts a garment being treated). Therefore soleplate construction can be of lower mass with a lower power heating element 14 since there is a much reduced need for energy storage than in known steam iron configurations. Also, there is no need for any water return system from the steam iron 10 back to the water reservoir of the steam iron stand (not shown), so the steam hose cord can be light and flexible.

As well as only dry steam being drawn up through the second inlet 29 from the evaporation chamber 19 into the inlet junction, some water droplets may become entrained in the steam flow into the inlet junction 16. However, as these droplets pass though the inlet junction 16 and encounter the fast-moving steam being expelled from the narrow inner nozzle 31, they are accelerated in the fast-moving steam flow and thereby atomised. They may therefore be converted to steam in the hot steam jet exiting the narrow nozzle inner 31, or may continue to the water-steam separator 18 where they will loop back through to the evaporation chamber 19 as described above to be converted back into steam.

The inlet passage 17 downstream of the inlet junction 16 is advantageously of a lower resistance to fluid flow than first and second inlets 28, 29 and the outlet 30 of the inlet junction 16. This helps ensure the creation of the low pressure zones L that result in the suction effect for drawing through steam and sucking up unevaporated water droplets from the evaporation chamber 19 just upstream of the point within the inlet junction 16 that the pressurised steam exits the narrow inner nozzle 31. For example, the pipe that comprises the inlet passage 17 may be of a larger cross-section than the outlet 30 of the inlet junction 16. To also prevent flow resistance downstream of the inlet junction 16 to maintain the venturi effect, the cross-sectional area of an inlet to the water-steam separator 18 may also be of a larger cross-section than the outlet 30 of the inlet junction 16. Furthermore, the opening in the central steam tube 23, and/or the total cross-sectional area of the steam vents 25, is/are advantageously larger than that of the outlet 30 of the inlet junction 16.

Referring to FIG. 3, an exemplary configuration of the steam iron 10 of the invention is shown, in which the water-steam separator 18 may be made of two parts, with the central steam tube 23 and base of the water-steam separator 18 being formed as part of the soleplate 13, and the frusto-conical housing 22 being formed as a separate component. The frusto-conical housing 22 may be separate from the steam cover 27 or may be formed integrally with the steam cover 27. The frusto-conical housing 22 and/or the steam cover 27 may be made from a high temperature resistant plastic, for weight-saving benefits, or may be made of metal.

The opening in the central steam tube 23 is advantageously of a larger cross-sectional area than the inlet of the water-steam separator 18 from the inlet passage 17. This helps to avoid flow resistance within the water-steam separator 18.

A soleplate of a conventional PSG steam iron would typically have a mass of around 800 g. As described above, this relatively large mass is required for storing thermal energy to re-evaporate any condensed water quickly. However, with a steam iron 10 according to the invention, a soleplate 13 of much lower mass can be used, and in one exemplary embodiment, the soleplate mass may be around 400 g.

Taking into account the body and other components of PSG steam irons, conventional PSG steam irons can weigh in the range of 1.0 kg-1.6 kg, and are typically around 1.2 kg. However, with the configuration of steam iron of the invention, the overall steam iron mass can be reduced to below 800 g, and may be within the range of 650 g-800 g, an optimum weight range for a PSG steam iron for ease of use in both vertical and horizontal ironing modes.

A soleplate heating element of a conventional PSG steam iron is typically required to have a power output of around 800 W in order to heat the relatively large mass of the soleplate in an acceptable operating time, and to re-heat the soleplate as heat is transferred during evaporation of condensed water droplets, to avoid too much of a temperature drop of the soleplate. However, with a steam iron 10 according to the invention, the power of the heating element 14 can be lower than in conventional PSG irons since the mode of operation of the steam iron 10 allows more time for the condensed water droplets d to be evaporated into steam, and there is less mass of the soleplate 13 to heat/re-heat. In an exemplary embodiment of the invention, 7 g of condensed water can be evaporated in 10 seconds of use. To evaporate 7 g of water, a 300 W heating element may be used, and an additional 200 W of power capacity may be provided to allow for heat loss during an ironing process. Therefore, the soleplate 13 of an exemplary embodiment of the invention may comprise a heating element 14 with a power of around 500 W, and embodiments of the invention may have a maximum of 500 W power rating for the soleplate heating elements 14.

With the lower power required on the soleplate 13, more power from the mains electricity supply may be expended at the boiler/steam generator to generate more steam. Certain countries have regulations on the maximum power for domestic products, which in some countries is 3000 W. Having a smaller proportion of the overall PSG steam iron system power consumption taken up by the heating element 14 of the soleplate 13 means that a larger proportion of this finite maximum power figure is available for steam generation in the boiler. Accordingly, the performance of the PSG steam iron system can be improved over known PSG steam irons, as it has been proven that performance of a steam iron in wrinkle removal is dependent on the amount of steam the steam ironing system can produce.

In the exemplary embodiments of the steam iron 10 of the invention shown and described above, the second inlet 29 which extends from the evaporation chamber 19 into the inlet junction, is disposed at an angle of 90 degrees to the axis of the inlet junction 16, that is the axis of the narrow inner nozzle 31 and the outer pipe 32. However, the invention is not limited to this particular configuration and advantageously, the angle between a duct that comprises the second inlet 29 and the outer pipe 32 may be less than 90 degrees.

The steam iron 10 of the invention is configured such that duct that comprises the second inlet 29 of the inlet junction 16 extends into the evaporation chamber 19 and terminates at a distal end which is spaced from an opposite surface of the evaporation chamber 19 by narrow gap "G" (as illustrated in FIG. 2). This gap G, in the exemplary embodiment of the invention shown in FIGS. 1 to 3, is the distance between the distal end of the duct of the second inlet 29 within the evaporation chamber 19 and the upper surface of the soleplate 13 within the evaporation chamber 19. This gap G may be between 1-4 mm, and may advantageously be around 2 mm. This small gap G helps unevaporated water on the upper surface of the soleplate 13 to be sucked up into the inlet junction 16 by the low pressure L of the venturi effect.

Although in the exemplary embodiments of steam iron 10 described above, the evaporation chamber is heated by the heating element 14 of the soleplate 13, the invention is not limited to this configuration and in an alternative embodiment, and the evaporation chamber may comprise a separate heating element, and/or may be separate from the soleplate 13.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A steam iron comprising a soleplate, a heating element for heating the soleplate, an inlet junction comprising a first inlet for receiving input steam from a steam generator and a second inlet, a water-steam separator connected to the inlet junction to receive steam from the inlet junction and separate steam from condensed water entrained in the steam, an evaporation chamber connected to the water-steam separator to receive condensed water from the water-steam separator and including a surface heated by said heating element to generate evaporated water from said condensed water, the evaporation chamber being connected to the second inlet, wherein the inlet junction comprises a venturi effect nozzle for expelling said input steam and to generate a reduced pressure in the region of the second inlet to draw said evaporated water into the inlet junction, wherein the venturi nozzle is disposed within an outer tube of the inlet junction and the second inlet is positioned upstream of the end of the venturi nozzle from which the input steam is expelled, with respect to the flow direction of the steam.

2. A steam iron according to claim 1 wherein an inlet duct fluidly connects an outlet of the outer tube to an inlet of the water-steam separator, and wherein the cross-sectional area of the inlet duct and of the inlet of the water-steam separator are each greater than the cross-sectional area of the outlet of outer tube.

3. A steam iron according to claim 2 wherein the water-steam separator comprises a steam outlet for dry steam to be supplied to steam vents formed in the soleplate, and a water outlet connected to the evaporation chamber.

4. A steam iron according to claim 3, wherein the cross-sectional area of the steam outlet of the separator is greater than the cross-sectional area of an outlet of outer tube of the inlet junction.

5. A steam iron according to claim 3, wherein the total cross-sectional area of the steam vents in the soleplate is greater than the cross-sectional area of an outlet of outer tube of the inlet junction.

6. A steam iron according to claim 1 wherein part of the evaporation chamber is defined by a surface of the soleplate.

7. A steam iron according to claim 1 wherein the second inlet of the inlet junction comprises a duct that extends into the evaporation chamber and terminates at a distal end which is spaced from an opposite surface of the evaporation chamber by a gap (G) of between 1 mm-4 mm.

8. A steam iron according to claim 1 wherein the evaporation chamber comprises a convoluted path between the water-steam separator and the second inlet of the inlet junction, defined by a plurality of upstanding walls from a surface of the evaporation chamber.

9. A steam iron according to claim 1, wherein the upstanding walls defining the convoluted path are formed integrally with the soleplate.

10. A steam iron according to claim 1 wherein the water-steam separator comprises a cyclonic separator.

11. A steam iron according to claim 1 wherein the soleplate has a mass of around 400 g.

12. A steam iron according to claim 1 wherein the mass of the steam iron is within the range of 650 g to 800 g.

13. A steam iron according to claim 1 wherein the soleplate heating element has a power output of less than 500 W.

14. A steam iron according to claim 1 further comprising a separate base unit comprising a steam generator including a water reservoir and a boiler, and a steam hose connecting the steam generator to the first inlet of the inlet junction, wherein the steam hose comprises a single duct for the supply of steam from the steam generator to the steam iron.

* * * * *